United States Patent [19]

Baumann

[11] Patent Number: 5,033,940

[45] Date of Patent: Jul. 23, 1991

[54] RECIPROCATING HIGH-PRESSURE COMPRESSOR PISTON WITH ANNULAR CLEARANCE

[75] Inventor: Heinz Baumann, Winterthur, Switzerland

[73] Assignee: Sulzer Brothers Limited, Winterthur, Switzerland

[21] Appl. No.: 467,021

[22] Filed: Jan. 18, 1990

[30] Foreign Application Priority Data

Jan. 19, 1989 [CH] Switzerland ..... 00163/89

[51] Int. Cl.[5] ..... F04B 1/04

[52] U.S. Cl. ..... 417/273; 417/266; 417/DIG. 1; 92/72; 92/170.1

[58] Field of Search ..... 417/262, 266, 273, DIG. 1; 92/72, 169.1, 170.1, 126

[56] References Cited

U.S. PATENT DOCUMENTS

| | | | |
|---|---|---|---|
| 4,366,747 | 1/1983 | Falendysz et al. | 417/273 |
| 4,551,074 | 11/1985 | Asaka et al. | 417/366 |
| 4,883,409 | 11/1989 | Strohmeier et al. | 417/265 |

FOREIGN PATENT DOCUMENTS

| | | | |
|---|---|---|---|
| 0046585 | 3/1982 | European Pat. Off. . | |
| 0269882 | 6/1988 | European Pat. Off. . | |
| 0963748 | 5/1957 | Fed. Rep. of Germany . | |
| 3135726 | 4/1982 | Fed. Rep. of Germany . | |
| 1018769 | 1/1953 | France | 417/262 |
| 253326 | 11/1948 | Switzerland | 417/262 |
| 2090645 | 7/1982 | United Kingdom . | |
| 85/01336 | 3/1985 | World Int. Prop. O. . | |

*Primary Examiner*—Leonard E. Smith
*Assistant Examiner*—David L. Cavanaugh
*Attorney, Agent, or Firm*—Kenyon & Kenyon

[57] ABSTRACT

The compressor comprises at least one high-pressure cylinder and piston unit having a piston which is guided in a cylinder liner and which is coupled with a crankshaft by way of a connecting element guided in the cylinder casing along the longitudinal axis of the cylinder. The piston is coupled with the connecting element by way of a mounting permitting movements of the connecting element relatively to the piston transversely of the longitudinal axis. Guidance of the piston is achieved without affect from oscillations of the connecting. The piston cooperates with the liner to bound a lubricant-free annular gap open over the whole longitudinal portion common to the liner and the piston. A dry gap ring seal can therefore be provided between the piston and the liner and ensures that the compression chamber remains seal tight even at pressures of above 60 bar. Preferably, the piston and the cylinder liner are each made of wear-resistant metal or ceramic material.

11 Claims, 1 Drawing Sheet

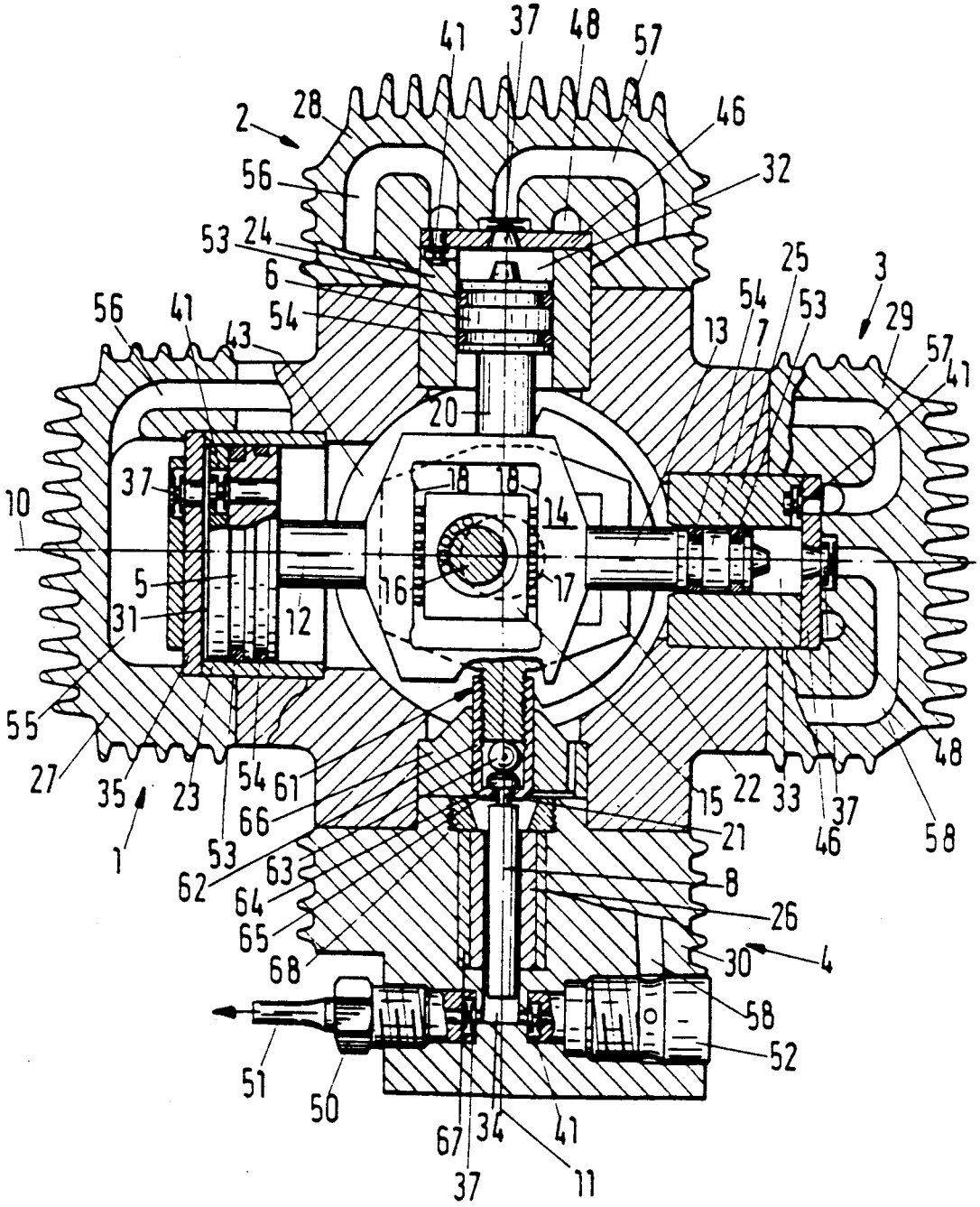
41
37
48
57
2
28
46
56
32
53
24
6
54
25
3
56
41
43
54
53
29
13
7
57
41
20
37
18
18
14
10
5
16
17
31
12
55
27
35
23
54
61
66
62
53
63
64
65
68
1
15
22
33
37
46
21
8
26
30
4
58
48
58
52
51
50
67
34
41
37
11

RECIPROCATING HIGH-PRESSURE COMPRESSOR PISTON WITH ANNULAR CLEARANCE

This invention relates to a reciprocating high-pressure compressor.

Heretofore, various types of compressors have been known for the compressing of fluid media such as natural gas. For example, U.S. Pat. No. 4,936,327 European Patent Application No. 0 269 882 describes a four stage compressor in which pistons are guided in respective cylinders in an oil-free manner by means of a crankshaft of a drive means. As described, each pair of opposed pistons are connected via a connecting element in the form of a yoke which, in turn, is driven from the crankshaft so that the connecting element is guided along a longitudinal axis of the cylinders in which the pistons slide. Other types of four stage compressors have also been known from U.K. Patent Application 2,090,645.

European Patent Application 0 269 081 describes a four stage small compressor wherein natural gas is compressed in a cylinder and piston unit effective as a final compression stage from a pressure of, for example, 60 bar to a pressure of, for example, 180 bar.

Generally, the known oil-free compressors having cylinder and piston units designed for pressures above 60 bar are provided with sealing and lubricating arrangements which are relatively elaborate. Also, such compressors generally require relatively frequent servicing.

Accordingly, it is an object of the invention to provide a dry operating high-pressure reciprocating compressor of improved construction.

It is another object of the invention to provide a reciprocating high-pressure reciprocating compressor which is capable of operating at high pressures of for example, up to 500 bar.

It is another object of the invention to provide for the automatic operation of a reciprocating high-pressure compressor with relatively large service intervals.

It is another object of the invention to simplify the sealing arrangements for a final stage of a multi-stage compressor for use at high pressure.

Briefly, the invention is directed to a reciprocating high-pressure compressor which is comprised of a housing defining a central chamber, a crankshaft rotatably mounted in the housing within the central chamber, at least one cylinder mounted in the housing to define a compressor chamber therein and a connecting element drivingly connected to the crankshaft for reciprocating movement along a longitudinal axis passing through the housing and the cylinder.

In accordance with the invention, a piston is disposed within the cylinder on the longitudinal axis of the cylinder as well as in spaced radial relation to the cylinder in order to define a continuous uninterrupted annular gap therebetween. This gap communicates the compressor chamber with the central chamber. In addition, a mounting couples the piston to the connecting element for movement therewith parallel to the longitudinal axis. The coupling also includes at least one bearing member between the piston and connecting member which is movable transversely of the longitudinal axis in order to permit relative transverse movements between the piston and the connecting element.

The mounting ensures, in a simple manner, particularly without any additional elaborate guide facility, that the piston is isolated from any oscillations of the connecting element which act transversely to the longitudinal axis of the cylinder. Thus, the piston is guided in parallel to the cylinder and is uneffected by such oscillations. Thus, the piston serves to define a dry gap ring seal with a correspondingly reduced clearance between the piston and cylinder.

The compressor may be constructed so that the piston has a wear resistant outer surface while the cylinder has a wear resistant surface facing the piston. In this case, the surface of the cylinder has a coefficient of heat expansion at least the same or greater than the coefficient of heat expansion of the piston. This provides a dry gap ring seal which ensures a substantially constant minimum clearance between the piston and cylinder within a predetermined temperature range determined in accordance with the operating conditions. Thus, a correspondingly reduced leakage loss which remains substantially constant throughout operation is ensured.

These and other objects and advantages of the invention will become more apparent from the following detailed description taken in conjunction with the accompanying drawing wherein:

The single Figure illustrates a horizontal sectional view through two horizontal planes of a reciprocating compressor constructed in accordance with the invention.

Referring to the drawing, the reciprocating high-pressure compressor includes a housing defining a central chamber 43 and four cylinders 1-4 mounted on the housing with respective pistons 5-8 guided therein. As illustrated, the cylinders 1, 3 have a common horizontal axis 10 disposed in the plane of the drawing whereas the other cylinders 2, 4 are disposed on a common horizontal axis 11 set back from the plane of the drawing.

The pistons 5, 7 have respective piston rods 12, 13 which are connected to a connecting element in the form of a yoke 14 which serves to couple the pistons 5, 7 with a slider 15 mounted on a crank pin 16 of a vertical crankshaft 17. This crankshaft 17 is rotatably mounted in the compressor housing within the central chamber 43 and is connected to a drive means, such as a motor (not shown), for example, an electric motor.

The slider 15 is slidably guided transversely to the longitudinal axis 10 between two guideways 18 in the yoke 14.

The pistons 6, 8 are connected, by way of a yoke 22 interconnecting their respective piston rods 20, 21, to a second slider (not shown) which is mounted on the crank pin 16 and which is displaceably guided transversely to the axis 11 in the yoke 22 which is at a 90° offset from the yoke 14.

The pistons 5-8 are guided in respective cylinder liners 23-26 and each bound a respective compression chamber 31-34 in the respective cylinders 1-4. The cylinders 1-4 are closed by respective releasably secured cylinder covers 27-30. The compression chamber 31 of the cylinder 1 effective as the first compression stage is bounded by an end plate 35 having a plurality, for example, four, of delivery valves 37 which are each associated with a passage and only one of which is shown. The piston 5 has corresponding inlet valves 41 which are each associated with a passage and which during the inlet stroke of the piston 5 produce a communication between the compression chamber 31 and the central chamber 43 separated therefrom by the piston 5, the chamber 43 being connected to a feed line (not shown) for the natural gas to be compressed.

The compression chambers 32, 33 in the cylinders 2, 3 respectively are each bounded by an end plate 46 which has a central delivery valve 37 and a number, for example, four, of inlet valves 41, only one of the inlet valves 41 being shown.

A delivery valve 37 is disposed in the cylinder 4 of the final compression stage in a bore which is present in the cylinder cover 30 and which communicates by way of a connecting nipple 50 with a delivery line 51 extending away from the compressor. An inlet valve 41 is disposed in a corresponding bore which is connected by way of a nipple 52 to a flow duct 58 connected to the compression chamber 33.

Corresponding delivery and inlet valves, the construction of which does not form part of this invention, are described in greater detail, for example, in U.S. Pat. No. 4,936,327.

During the inlet stroke of the piston 5 (shown at its top dead center position), natural gas supplied to the central chamber 43 at a pressure of, for example, 10 bar is intaken through the opened inlet valves 41. During the delivery or compression stroke, the gas is compressed to a pressure of, for example, 5 bar and flows through the open valves 37 into a cylinder chamber 55 and through a flow duct 56 and an annular duct 48 to the second compression stage embodied by the cylinder 2.

The gas intaken into the compression chamber 32 during the inlet stroke of the piston 6 is compressed during the following compression stroke to a pressure of, for example, 20 bar and flows through the open valve 37 and a flow duct 57 to the third compression stage embodied by the cylinder 3, the piston 7 thereof being shown in a bottom dead center position. The gas intaken into the compression chamber 33 during the inlet stroke of the piston 7 is compressed during the next delivery stroke to a pressure of, for example, 60 bar and supplied through the flow duct 58 and through communicating ducts in the nipple 52 to the final compression stage embodied by the cylinder 4.

The gas intaken into the compression chamber 34 during the inlet stroke of the piston 8 is compressed to a pressure of, for example, 180 bar during the delivery stroke and flows through the open delivery valve 37 and through delivery line 51 to a gas fuel tank (not shown), for example, the fuel tank of a motor vehicle.

The pistons 5–8 run dry in the liners 23–26 respectively. The pistons 5–7 each have a ring seal 53 and a guide ring 54 made of a self-lubricating material, such as Teflon, suitable for dry running, whereas the piston 8 co-operates with the bore of the linear 26 to bound an annular gap open over the whole length common to the piston 8 and liner 26. The pistons 5, 6, 7 are each rigidly connected to the respective yoke 14, 22 while the piston 8 of the final stage is connected to the yoke 22 by way of a mounting 61 which is rigidly connected to the yoke 22 and which permits relative movements thereof transversely to the longitudinal axis 11 of the cylinder 4.

The mounting 61 comprises a sleeve 62 threadably secured to the yoke 22 and, rotatably mounted in the sleeve 62, a bearing element—shown in the drawing as a ball 63 movable relatively to the piston 8 and to the yoke 22—by way of which a bearing part of the yoke 22 co-operates for movement transversely to the longitudinal axis 11 with a head part 64 disposed on piston rod 21 of piston 8 and introducible into the sleeve 62. The head part 64 is mounted for movement transversely to the longitudinal axis 11 of the cylinder 4 by a collar part 65 of the sleeve 62, the part 65 extending with clearance around the piston rod 21.

By way of the sleeve 62, the yoke 22 is guided for movement along the longitudinal axis 11 in a guide element 66 retained in the compressor cylinder block (i.e. housing). By way of the ball 63, the yoke 22 is connected without clearance along the longitudinal axis 11 to the piston 8 experiencing the operating pressure. The rotatable ball 63 prevents any transmission of transverse forces to the piston 8 from the yoke 22.

The yoke 22 is slidingly guided by the piston 6 in the liner 24 and by the sleeve 62 in the guide member 66 with corresponding lateral clearance. It has been found that the mounting 61, even when in a form in which the difference between the diameter of the bore of the cylinder liner 26 and the diameter of the piston 8 is approximately from 0.004 to 0.01 mm, can ensure reliable parallel guidance of the piston 8 unaffected by oscillations of the yoke 22. This arrangement facilitates the construction of a dry gap ring seal between the piston 8 and the cylinder liner 26 which ensures the necessary sealing of the compression chamber 34 even at the pressure difference of 180 bar—or at even higher pressure differences of, for example, up to 500 bar—occurring in the final stage of the compressor between the compression chamber 34 and the central chamber 43. The sealing effect arises because of the friction of the gas flowing through the narrow annular gap.

The piston 8 and the liner 26 are both made of a wear-resistant material. In the construction shown, the piston 8 is made of hard metal and the liner 26 of a correspondingly wear-resistant ceramic substance, such as silicon carbide or silicon nitride, whose heat expansion coefficient corresponds at least substantially to the heat expansion coefficient of the material used for the piston 8. Consequently, when the dry-running parts heat up in operation, the required clearance between the piston 8 and the liner 26 and, therefore, the leakage loss determined by such clearance, remain substantially constant over the entire range of operating temperatures, for example, in a range of ambient temperatures between −40° C. and +50° C. In the pressure relationships effective in the construction hereinbefore described, a constant operationally acceptable leakage loss of, for example, less than 10% can be achieved in this way between the compression chamber 34 and the central chamber 43.

The liner 26, which can be introduced directly into a bore in the cylinder cover 30 or, as shown, can be disposed in a sleeve 67 introducible into a corresponding bore, is secured in the cylinder cover by a retaining ring 68 adapted to be screwed into the cover 30. The liner 26 disposed in the sleeve 67 and retained therein, for example, by shrink fitting, can be made of a material, such as zirconium oxide, whose coefficient of heat expansion is greater than that of the material used for the piston 8. If the material of the sleeve 67, for example a Ni-Fe-base alloy, is suitable, the sleeve 67 can be used as a compensating sleeve which compensates for heat expansion of the liner 26 on the inside except for a predetermined amount corresponding to the heat expansion of the piston 8, thus enabling the required clearance between the piston 8 and the liner 26 to be maintained substantially constant.

At the relatively reduced pressure differences of from 5 to 60 bar—or up to, for example, 80 bar—which occur near the cylinders 1–3, in each case between the respective compression chambers 31–33 and the central chamber 43, the use of wear-resistant components as required for the final compression stage is unnecessary. At these pressure differences, the operation of the dry piston ring seals between the pistons 5–7 and the respective liners 23–25 is not appreciably impaired by oscillations of the yoke 14 guided by way of the pistons 5, 7 in the liners 23, 25 respectively and of the yoke 22 guided by way of the piston 6 and sleeve 62 in the liner 24 and guide element 66 respectively. Hence leakage losses are not excessive.

Numerous variants of the compressor construction are feasible. For example, some other form of rotatable member, such as one having cylindrical or part-spherical bearing surfaces, can be provided in the mounting 61 instead of a spherical bearing element. Instead of the one-piece sleeve 62 provided in the mounting 61 (shown in simplified form), a two-piece sleeve adapted to be disposed in appropriate manner on the yoke 22 or some other constructional variant of the retaining arrangement can be provided.

The piston 8 can have a relatively soft core and a coating therearound of hard metal or of a corresponding wear-resistant material or can be made of a ceramic material. Also, it may be convenient for the liner 26 to be made of hard metal. Similarly, the piston 8 and/or the liner 26 can be made of materials other than those described, for example, metal compounds having appropriate coefficients of heat expansion. Furthermore, at least one of the running surfaces of the piston 8 and of the cylinder liner 26 can be made of a thin, homogeneous layer of amorphous diamond-like carbon. Such layers can be applied on the concerning part or on both parts, respectively, at a slight cost, by a method suitable for mass production, and at a relatively low treating temperature, for example about 200° C., which is easy on the supporting material. If the heat expansion coefficient of the material used for the cylinder 30 is at least substantially the same as the heat expansion coefficient of the material used for the piston 8, a construction is possible in which such a layer is applied directly on the cylinder bore.

The invention is not limited to compressors of the kind hereinbefore described and illustrated but is also of use for other single-stage or multi-stage constructions and for other purposes, for example, for respiratory compressors or cryological compressors. In the case of multistage compressors, at least one further piston and cylinder unit can have a mounting as described above and/or cooperating members made of a wear-resistant substance.

The invention thus provides a reciprocating high-pressure compressor which does not require an elaborate sealing arrangement for the final stage of the compressor.

Further, the invention provides a compressor which can be operated at high pressure, for example of up to 500 bar as well as with relatively long service intervals.

The embodiments of the invention in which an inclusive property or privilege is claimed are defined as follows:

1. A reciprocating high-pressure compressor comprising a housing defining a central chamber;

a crankshaft rotatably mounted in said housing within said central chamber;

at least one cylinder mounted on said housing and defining a compressor chamber therein;

a connecting element drivingly connected to said crankshaft for reciprocating movement along a longitudinal axis passing through said housing and said cylinder;

a piston disposed within said cylinder on said axis and in spaced radial relation to said cylinder to define a continuous uninterrupted annular gap therebetween, said gap communicating said compressor chamber with said central chamber; and a mounting coupling said piston to said connecting element for movement therewith parallel to said longitudinal axis, said mounting including at least one bearing member between said piston and said connecting element moveable transversely of said longitudinal axis to permit relative transverse movements therebetween.

2. A compressor as set forth in claim 1 wherein said bearing member has a convex bearing surface contacting each of said piston and said connecting element.

3. A compressor as set forth in claim 1 wherein said bearing member is a ball.

4. A compressor as set forth in claim 1 wherein said piston has a wear resistant outer surface and said cylinder has a wear resistant surface facing said piston, said surface of said cylinder having a coefficient of heat expansion being at least the same or greater than the coefficient of heat expansion of said piston.

5. A compressor as set forth in claim 4 wherein said surface of said piston is made of hard metal.

6. A compressor as set forth in claim 5 which further comprises a cylinder liner of ceramic material between said piston and said cylinder with said gap disposed between said piston and said liner.

7. A compressor as set forth in claim 6 which further comprises a sleeve between said cylinder and said liner to compensate for at least some heat expansion of said liner.

8. A compressor as set forth in claim 6 wherein said liner is made of a material selected from the group consisting of silicon carbide, silicon nitride and zirconium oxide.

9. A compressor as set forth in claim 1 wherein said gap has a width of from 0.004 to 0.01 millimeter.

10. A compressor as set forth in claim 1 which further comprises an inlet valve for introducing a compressible medium into said compressor chamber and an outlet valve for exhausting a compressed medium from said compressor chamber.

11. A compressor as set forth in claim 1 wherein said mounting includes a sleeve removably secured to said connecting element and housing said bearing element therein, said sleeve having a collar part at one end engaging with a recessed head of said piston in spaced relation thereto.

* * * * *

UNITED STATES PATENT AND TRADEMARK OFFICE

CERTIFICATE OF CORRECTION

PATENT NO. : 5,033,940

DATED : July 23, 1991

INVENTOR(S) : HEINZ BAUMANN

It is certified that error appears in the above-identified patent and that said Letters Patent is hereby corrected as shown below: On the Title page In the Abstract, lines 10, 11 change "connecting." to -connecting element.-

Column 1, line 10 change "European" to -and European -

Signed and Sealed this

Twenty-third Day of February, 1993

*Attest:*

STEPHEN G. KUNIN

*Attesting Officer*

*Acting Commissioner of Patents and Trademarks*